US008448908B2

(12) United States Patent
Taurins

(10) Patent No.: US 8,448,908 B2
(45) Date of Patent: May 28, 2013

(54) SUPPORT DEVICE

(76) Inventor: Ellen S. Taurins, Flushing, NY (US)

( * ) Notice: Subject to any disclaimer, the term of this patent is extended or adjusted under 35 U.S.C. 154(b) by 232 days.

(21) Appl. No.: 12/691,131

(22) Filed: Jan. 21, 2010

(65) Prior Publication Data

US 2010/0187384 A1 Jul. 29, 2010

Related U.S. Application Data

(60) Provisional application No. 61/147,585, filed on Jan. 27, 2009.

(51) Int. Cl.
*A47H 1/00* (2006.01)
*B42F 13/00* (2006.01)
*A47F 5/08* (2006.01)

(52) U.S. Cl.
USPC ..... 248/264; 248/339; 211/113; 211/106.1

(58) Field of Classification Search
USPC ..... 248/201, 317, 200.1, 214, 27, 251, 248/261, 262, 264, 302, 303, 304, 339, 690; 211/106.1, 124, 113, 35, 90.03, 119, 123; 206/279, 286, 289
See application file for complete search history.

(56) References Cited

U.S. PATENT DOCUMENTS

| | | | | |
|---|---|---|---|---|
| 1,603,382 | A * | 10/1926 | Fischer | 211/35 |
| 1,606,587 | A | 11/1926 | May | |
| 3,868,906 | A * | 3/1975 | Cameron | 211/113 |
| 4,037,728 | A * | 7/1977 | Cameron | 211/124 |
| 4,372,450 | A * | 2/1983 | Licari et al. | 211/106.01 |
| D274,773 | S | 7/1984 | Coleman | |
| 4,905,826 | A * | 3/1990 | Martin | 206/286 |
| D327,589 | S | 7/1992 | Ma | |
| D423,856 | S * | 5/2000 | Duggan | D6/549 |
| D425,741 | S * | 5/2000 | Duggan | D6/523 |
| D455,593 | S * | 4/2002 | Hoernig | D6/549 |
| 6,857,528 | B2 | 2/2005 | Klein et al. | |
| 2006/0113264 | A1 | 6/2006 | Ferber et al. | |
| 2010/0187384 | A1 * | 7/2010 | Taurins | 248/201 |

FOREIGN PATENT DOCUMENTS

TW 522821 U1 * 3/2003

* cited by examiner

*Primary Examiner* — Tan Le
(74) *Attorney, Agent, or Firm* — James Ray & Assoc

(57) ABSTRACT

A support device for supporting at least one predetermined foldable member includes a pair of bracket members for mounting on a predetermined vertical structure a predetermined distance apart, a securing mechanism operably connected to each bracket member and engageable with such predetermined vertical structure for securing each of such bracket members to such predetermined vertical structure, and a support rod manufactured from a first predetermined material and having a first predetermined size and a first predetermined shape and including a first end and a second end, such support rod for supporting such at least one predetermined foldable member releasably thereon and being releasably supportable in a substantially horizontal position by such bracket members.

19 Claims, 6 Drawing Sheets

SUPPORT DEVICE

CROSS REFERENCE TO RELATED APPLICATION

This patent application is related to and claims priority from U.S. Provisional Patent Application Ser. No. 61/147,585 filed Jan. 27, 2009.

FIELD OF THE INVENTION

The present invention relates, in general, to a support device for use in supporting at least one predetermined foldable member and, more particularly, this invention relates to a support device which is attachable to a predetermined vertical structure, such support device being for supporting at least one predetermined foldable member, such at least one predetermined foldable member including, but not limited to items such as blankets, bed spreads, comforters, throws, afghans, quilts, rugs, curtains, drapes, furniture covers, and the like.

BACKGROUND OF THE INVENTION

Prior to the conception and development of the present invention, foldable covering members, such as bedspreads, comforters, quilts, throws, afghans, blankets, throw rugs, furniture covers and the like, are generally well known in the prior art. However, after making a bed, tidying a room, or when preparing for sleep, many people find they have extra covering members, such as decorative quilts and throw blankets with no convenient place to put them. Moreover, temperatures change throughout the year, and it is often necessary to lessen the amount of blankets on a bed, daybed, couch, futon, etc. A lot of space in a room can be taken up by extra bedding and covering members. Many people throw the covering member or members on a chair, on the floor, or on the edge of furniture, such as a bed. If an individual attempts to clean up, he or she is often forced to store the extra items in a cedar chest, in the back of a closet, on a high shelf, in an attic, in a basement, and other inconvenient places that are hard to reach, and not easily accessible.

Specifically of interest to the present invention are the following: May, U.S. Pat. No. 1,606,587, discloses a display rack for holding comforters and blankets. The rack is mounted within a cabinet and includes a plurality of horizontal arms.

Klein, et al, U.S. Pat. No. 6,857,528, discloses a storage rack which hangs on the upper edge of a base cabinet door. A pair of hanger brackets fit on the door edge and are constructed to accommodate the plain edge of a flush mounted door or the stepped edge of a recessed cabinet door. Hooks on the inside parts of the brackets receive mounting fixtures used to attach storage devices such as baskets, trays, shelves, paper towel holders, food wrap dispensers, towel hooks or towel bars.

Coleman, U.S. Design Pat. No. D274,773, discloses the ornamental design for a rack for quilts, blankets, and spreads.

Ma, U.S. Design Pat. No. D327,589, discloses the ornamental design for a quilt rack.

Ferber, et al, U.S. Publication No. 20060113264, discloses a quilt rack to hang and display quilts on flat wall surfaces so as to support and frame the displayed quilt and produce a more pleasing and appealing display while protecting the quilt from drooping or sagging. Such quilt rack requires a four inch fabric pocket on the back of the quilt, and that, along with the rack, produces a uniform support over the length of the quilt eliminating wrinkles, droops, sags or uneven portions on the fabric surface.

SUMMARY OF THE INVENTION

The present invention provides a support device for supporting at least one predetermined foldable member. Such support device includes a pair of bracket members for being mounted on a predetermined vertical structure a predetermined distance apart. A securing means is operably connected to each bracket member and engageable with such predetermined vertical structure for securing each of such bracket members to such predetermined vertical structure. A support rod is manufactured from a first predetermined material and has a first predetermined size and a first predetermined shape. Such support rod includes a first end and a second end and is releasably supported in a substantially horizontal position by such bracket members while such support rod supports such at least one predetermined foldable member releasably thereon.

OBJECTS OF THE INVENTION

It is, therefore, one of the primary objects of the present invention to provide a convenient easy to reach device for use in supporting foldable members such as bedding, comforters, bedspreads, rugs, draperies, and the like, which may be attached to a predetermined vertical structure such that when a person wants to store such items he or she can remove them from their positions within a room and conveniently support them on such device.

Another object of the present invention is to provide a support device for use for use in supporting extra bedding, such as quilts, comforters, afghans, blankets, and bedspreads in an out of the way location such as behind a door, on a wall, etc. thereby freeing up space in a room and lessening the bulk of bedding on a bed.

Still another object of the present invention is to provide a device for supporting bed coverings which is easy and inexpensive to install.

Yet another object of the present invention is to provide a decorative support device for supporting at least one foldable member, such decorative support device being attachable to a predetermined vertical structure such as a door, a wall, a cabinet, and the like; such decorative support member having an aesthetic appearance.

An additional object of the present invention is to provide an easy to install support device which takes up little space and can be used to support quilts, decorative blankets, throws, afghan, throw rugs, and other foldable members.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
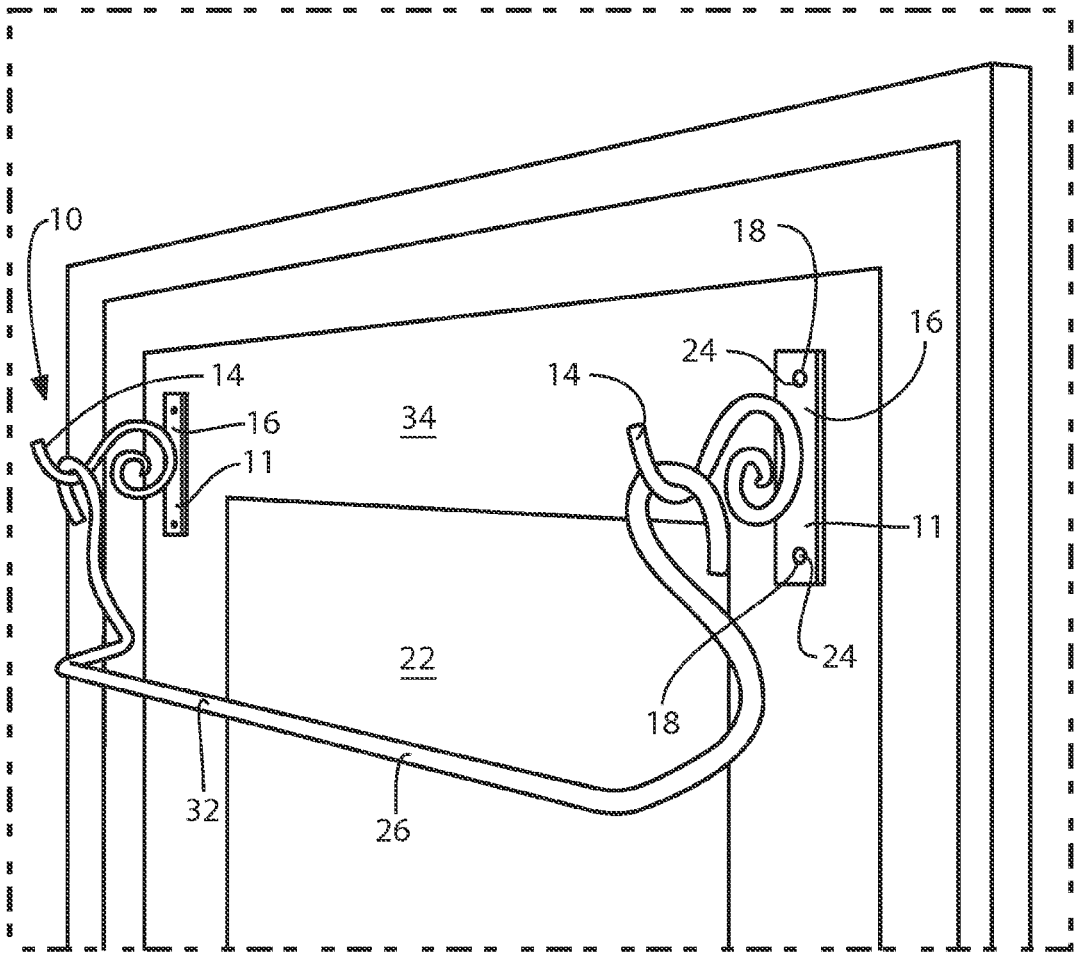
FIG. 1 is a partial perspective view of the invention according to one embodiment of the invention; such plate members 16 are mounted on a predetermined vertical structure 22 (the back of a door 34) and the support rod 26 is being supported by such hook members 14.
Figure 2:
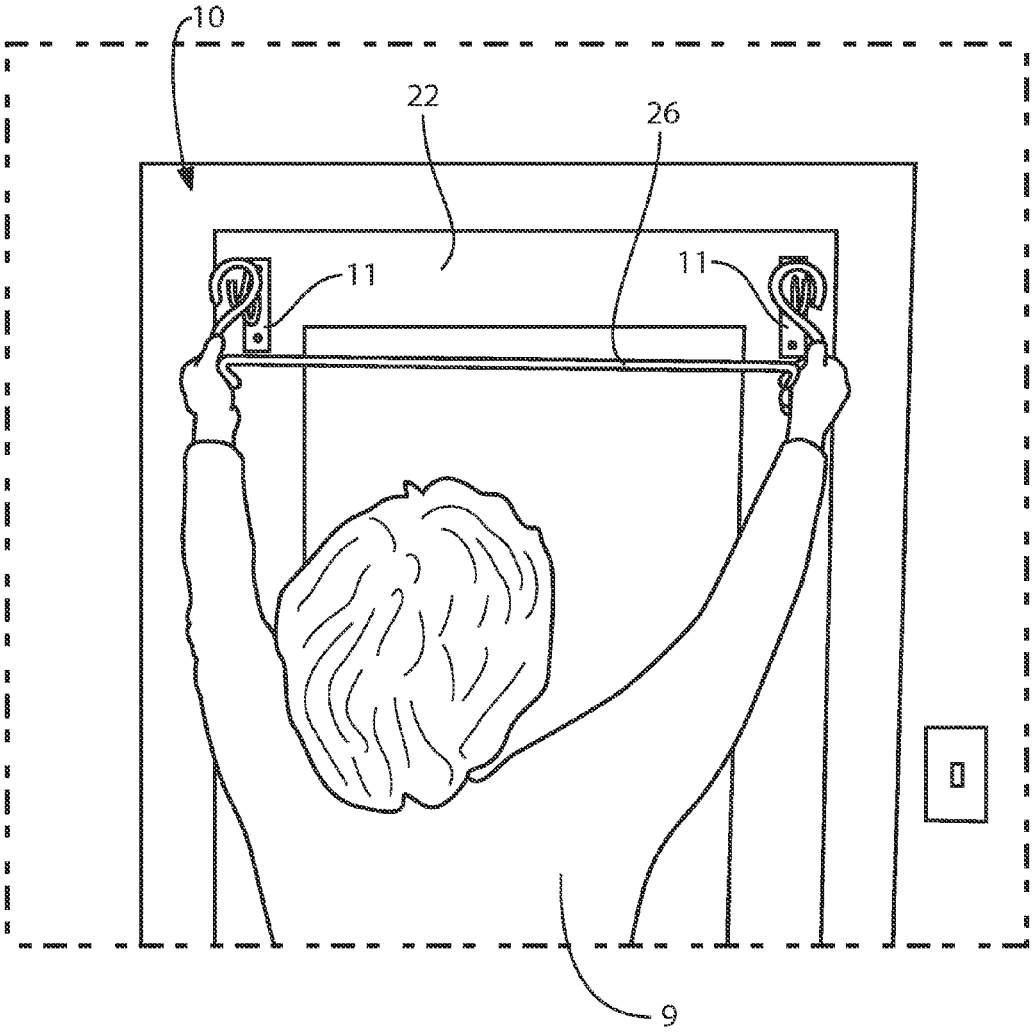
FIG. 2 is a partial perspective view of the invention according to one embodiment of the invention in which a user 9 is illustrated removing such support rod 26 from such hook members 14.
Figure 3:
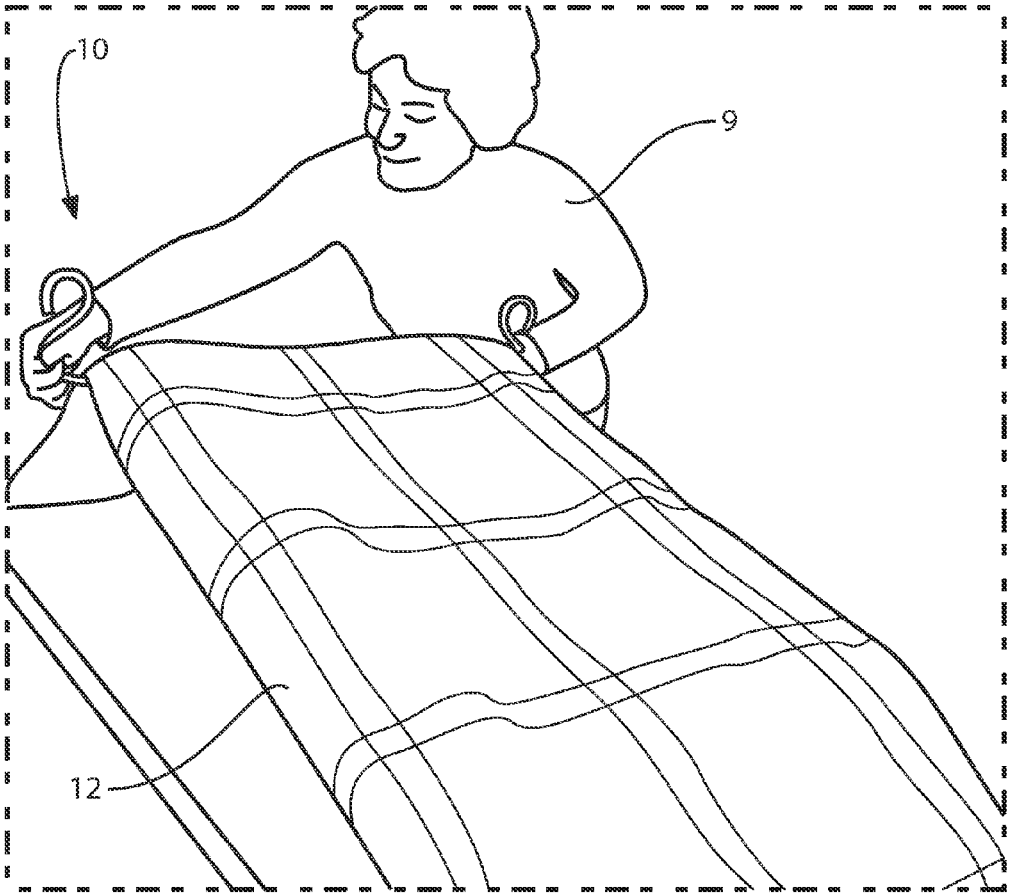
FIG. 3 is a partial perspective view of the invention according to one embodiment of the invention in which a user 9 is illustrated placing such at least one foldable member 12 (a comforter) onto the support rod 26.
Figure 4:
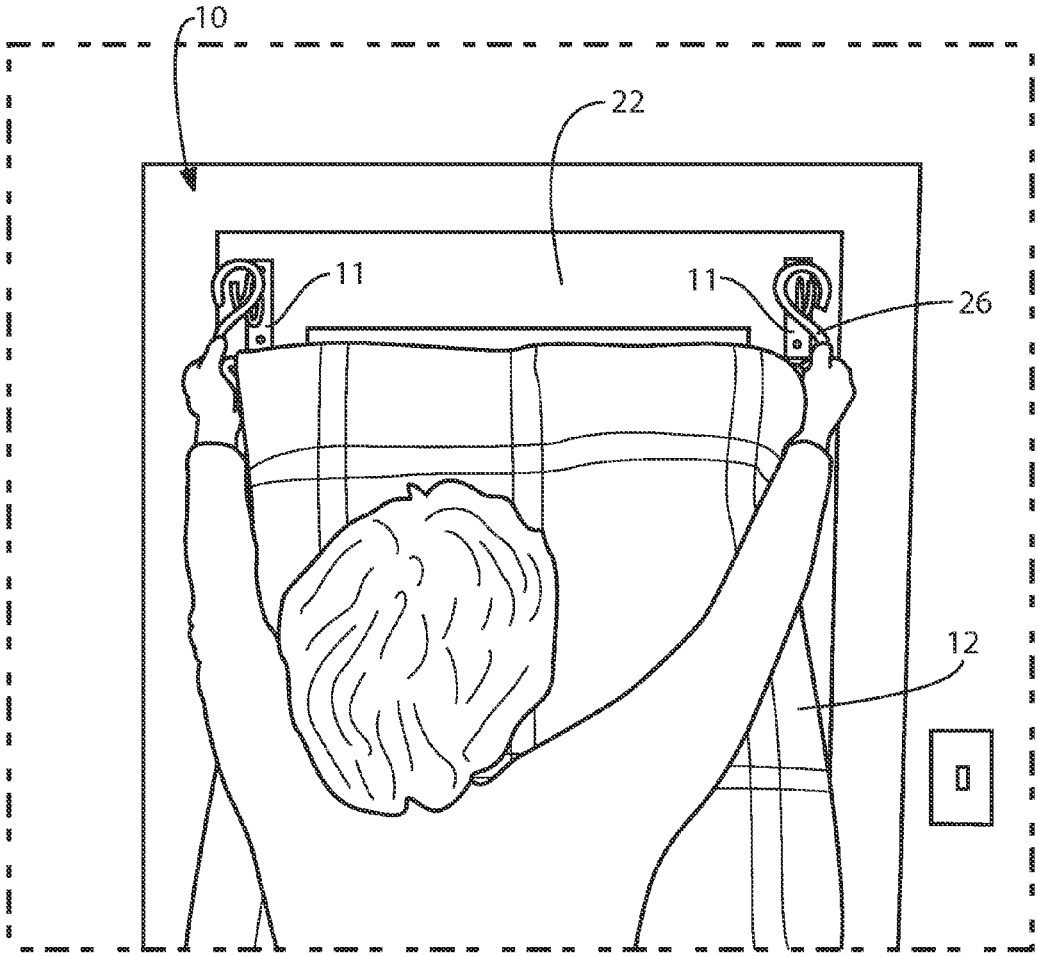
FIG. 4 is a partial perspective view of the invention according to one embodiment of the invention in which a user 9 is illustrated hanging the support rod 26 on the hook members 14 and the support rod 12 is supporting such predetermined foldable member 12.
Figure 5:
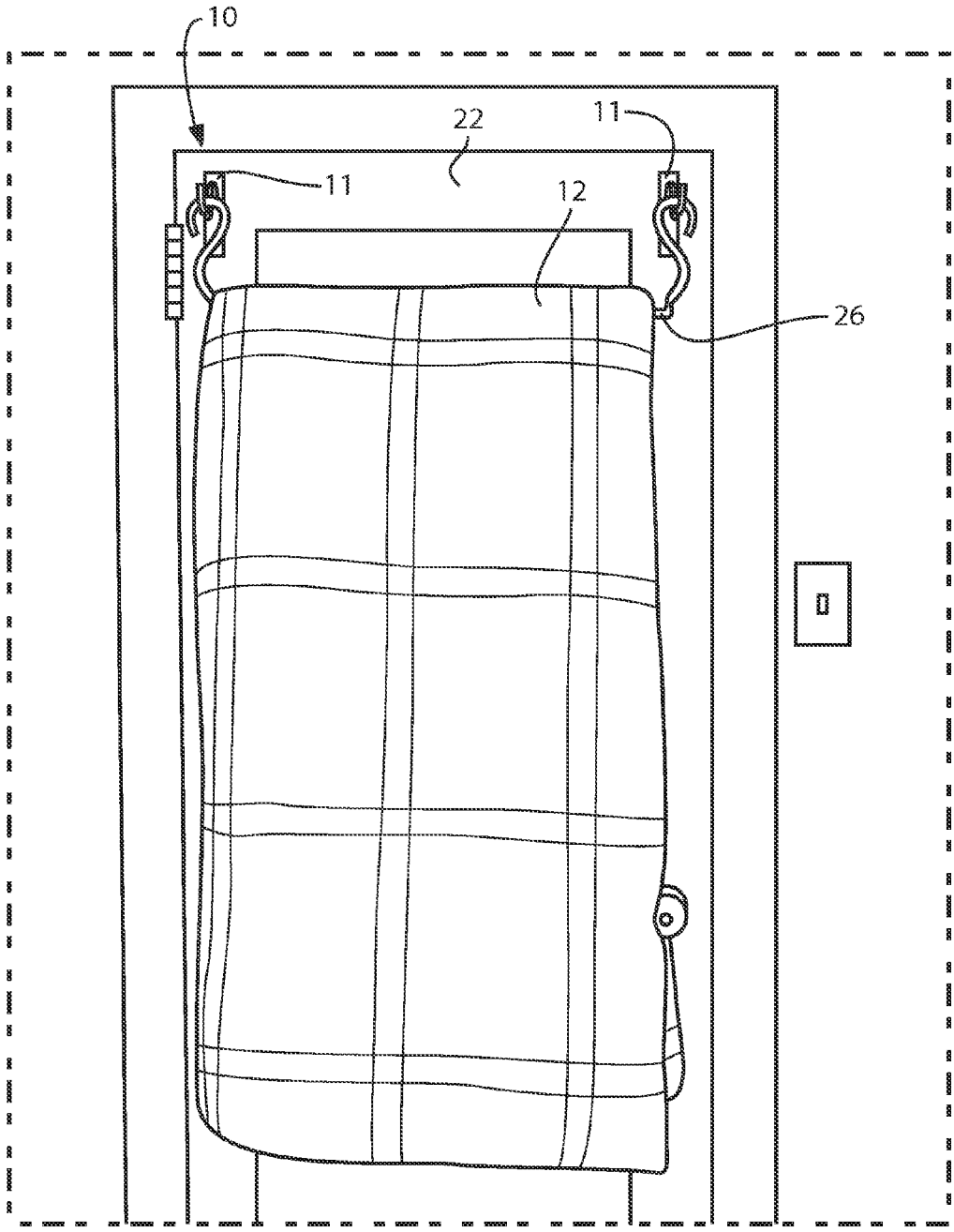
FIG. 5 is a partial perspective view of the invention according to one embodiment of the invention in which such at least one foldable member is depicted being supported by the device.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIGS. 1-6.

A support device, generally designated 10, for supporting at least one predetermined foldable member 12 is provided. Such predetermined foldable member may be a type of bedding, such as a comforter, quilt, bedspread, blanket, sheets, afghan, and the like. Such predetermined foldable member may also be curtains, drapes, a rug, a throw, a furniture cover, etc.

Such support device 10 includes a pair of bracket members 11 for being mounted on a predetermined vertical structure 22 a predetermined distance apart. Such predetermined vertical structure may be a door, a wall, a cabinet, etc., upon which such bracket members may be mounted.

A securing means 18 is operably connected to each bracket member 11 and engageable with such predetermined vertical structure 22 for securing each of such bracket members 11 to such predetermined vertical structure 22.

A support rod 26 is manufactured from a first predetermined material and has a first predetermined size and a first predetermined shape. Such support rod includes a first end 31 and a second end 33 and is releasably supported in a substantially horizontal position by such bracket members 11 while such support rod 26 supports such at least one predetermined foldable member 12 releasably thereon. It is presently preferred that such first predetermined material is at least one of metal, plastic and a combination thereof. It is presently most preferred that such first predetermined material is a metal. Preferably such metal is at least one of aluminum, steel, wrought iron, and a combination thereof.

It is presently preferred that such bracket members 11 include a pair of plate members 16 each manufactured from a second predetermined material and having a second predetermined size and a second predetermined shape for being mounted on such predetermined vertical structure 22. It is presently preferred that such second predetermined material is at least one of metal, plastic and a combination thereof. It is presently most preferred that such second predetermined material is a metal. Preferably such metal is at least one of aluminum, steel, wrought iron, and a combination thereof. It is presently preferred that such plate members 16 are substantially flat.

Such bracket members 11 further preferably include a pair of hook members 14, each manufactured from a third predetermined material and having a third predetermined size and a third predetermined shape and including a hooked portion at a front end thereof, each hook member 14 being attached at a rear end thereof perpendicularly to a predetermined one of such plate members 16. It is presently preferred that such third predetermined material is at least one of metal, plastic and a combination thereof. It is presently most preferred that such third predetermined material is a metal. Preferably such metal is at least one of aluminum, steel, wrought iron, and a combination thereof.

It is presently preferred that such securing means 18 is a screw type securing means 24 and each plate member 16 includes at least one aperture disposed there through at a predetermined location for receiving such screw type securing means 24. It is presently most preferred that such plate members 16 each include two apertures disposed there through, a first one of each of such apertures disposed through a first end of such plate member 16 and a one of each of such second apertures disposed through a second opposite end of such plate member 16.

Figure 6:
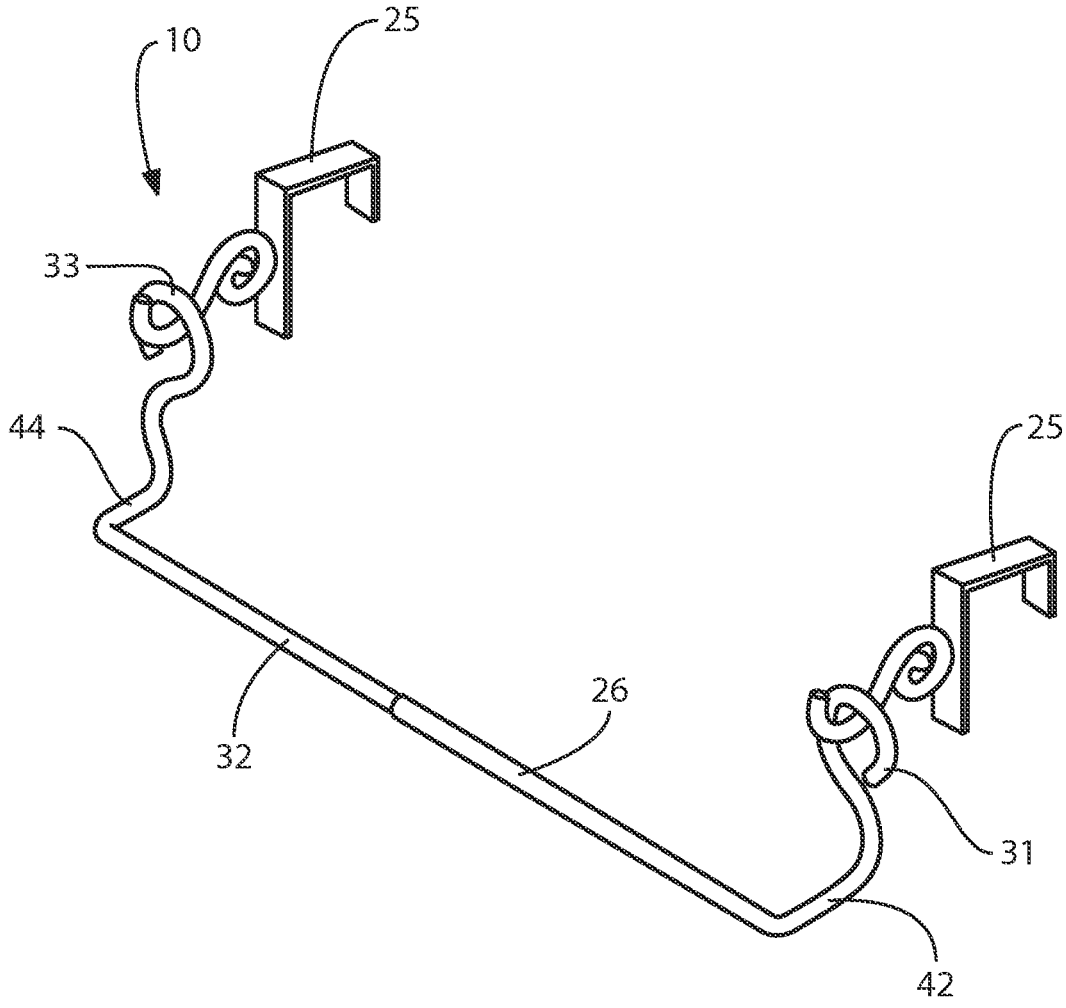
FIG. 6 is a partial perspective view of the invention according to one embodiment of the invention in which hanger members 25 are attached to such plate members 16 and such support rod 26 is telescoping.

According to another embodiment, as illustrated in FIG. 6, each plate member 16 includes a hanger member 25 having a fourth predetermined shape and a fourth predetermined size operably connected closely adjacent a top portion of each of such plate members 16 and engageable with a top portion of a door 34 such that each plate member 16 may be attached to such door 34 a predetermined distance apart from each other. Each plate member 16 may be integrally formed with each respective hanger member 25.

It is presently preferred that such support rod 26 is substantially straight. It is further presently preferred that each end of such support rod 26 is formed as a hook. Furthermore, it is presently most preferred that such support rod 26 includes first 42 and second 44 outwardly extending portions connected to each hooked end thereof at first ends thereof and a substantially straight middle portion 32 connected to each first and second outwardly extending portion at second ends thereof. It is meant that each end of such support rod is bent in a predetermined manner such that when such support rod 26 is disposed on such hook members 14 a substantially straight middle portion 32 of such support rod 26 is extended a predetermined distance from at least one of such hook members 14, such predetermined vertical structure 22, such plate members, such ends of support rod and a combination thereof. According to one embodiment, such support rod 26 is telescoping as illustrated in FIG. 6.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A support device for supporting at least one predetermined foldable member, said support device comprising:

a. a pair of bracket members for being mounted on a predetermined vertical structure a predetermined distance apart;

b. a securing means operably connected to each bracket member and engageable with such predetermined vertical structure for securing each of said bracket members to such predetermined vertical structure; and c. a support rod manufactured from a first predetermined material and having a first predetermined size and a first predetermined shape and including a substantially straight middle portion, a first end and a second end, said support rod for being releasably supported in a substantially horizontal position by said bracket members and said support rod for supporting such at least one predetermined foldable member releasably thereon, whereby each end of said support rod has a substantially straight portion that directly terminates said substantially straight middle portion and is so bent that said substantially straight middle portion of said support rod is spaced, in a generally horizontal plane, from the predetermined vertical structure and extends outwardly, in said generally horizontal plane, past said pair of mounting brackets and whereby said substantially straight middle portion of said support rod further extends downwardly past said pair of mounting brackets.

2. A support device according to claim 1 wherein said bracket members include a pair of plate members each manufactured from a second predetermined material and having a second predetermined size and a second predetermined shape for being mounted on such predetermined vertical structure and a pair of hook members, each manufactured from a third predetermined material and having a third predetermined size and a third predetermined shape including a hooked portion at a front end thereof, each hook member being attached at a rear end thereof perpendicularly to a predetermined one of said plate members.

3. A support device according to claim 2 wherein said plate members are substantially flat.

4. A support device according to claim 2 wherein said securing means is a screw type securing means and each plate member includes at least one aperture disposed there through at a predetermined location for receiving said screw type securing means.

5. A support device according to claim 4 wherein each of said plate members includes two apertures disposed there through, a first one of each of said apertures disposed through a first end of said plate member and a one of each of said second apertures disposed through a second opposite end of said plate member.

6. A support device according to claim 1 wherein each plate member further includes a hanger member having a fourth predetermined shape and a fourth predetermined size operably connected closely adjacent to a top portion of each of said plate members and engageable with a top portion of a door and such that each plate member may be attached thereto a predetermined distance apart from each other.

7. A support device according to claim 1 wherein said support rod is substantially straight.

8. A support device according to claim 1 wherein each end of said support rod is formed as a hook.

9. A support device according to claim 8 wherein said support rod further includes first and second outwardly extending portions connected to each hooked end thereof at first ends thereof and a substantially straight portion connected to each first and second outwardly extending portion at second ends thereof.

10. A support device according to claim 1 wherein said support rod is telescoping.

11. A support device according to claim 1 wherein said first predetermined material is at least one of metal, plastic and a combination thereof.

12. A support device according to claim 11 wherein said first predetermined material is a metal.

13. A support device according to claim 11 wherein said metal is at least one of aluminum, steel, wrought iron, and a combination thereof.

14. A support device according to claim 2 wherein said second predetermined material is at least one of metal, plastic and a combination thereof.

15. A support device according to claim 14 wherein said second predetermined material is a metal.

16. A support device according to claim 15 wherein said metal is at least one of aluminum, steel, wrought iron, and a combination thereof.

17. A support device according to claim 2 wherein said third predetermined material is at least one of metal, plastic and a combination thereof.

18. A support device comprising:

a. a pair of bracket members being disposed, during use, in a generally vertical plane and in a horizontally spaced apart relationship with each other;

b. a pair of first hook shaped members, each of said pair of first hook shaped members having a proximal end thereof attached to a surface of one of said pair of bracket members, and having a distal end thereof spaced from said surface; and c. support rod including:

i. a substantially straight middle portion disposed, during use of said support rod, in a substantially horizontal position;

ii. a pair of elongated substantially straight portions, each of said pair of elongated portions directly terminating a respective end of said substantially straight middle portion and extending, during said use of said support rod, from said respective end of said substantially straight middle portion in a generally horizontal plane and in direction toward said surface of a respective mounting bracket;

iii. a pair of second hook shaped members disposed, during said use of said support rod, in said generally vertical plane and oriented along a length of said substantially straight middle portion of said support rod, each of said pair of second hook shaped members having a proximal end thereof attached to and directly terminating an end of a respective one of said pair of elongated portions and having a distal end thereof supported, in abutting engagement, on a distal end of a respective one of said pair of first hook shaped members.

19. A support device consisting of:

a. a pair of bracket members having a generally straight first portion being disposed, during use of said pair of brackets, in a generally vertical plane and in a horizontally spaced apart relationship with each other and having an L-shaped second portion extending, during said use of said pair of brackets, from an upper end of said first portion, wherein one leg of said L-shaped second portion is disposed generally parallel with said first portion;

b. a pair of first hook shaped members, each of said pair of first hook shaped members having a proximal end thereof attached to a surface of one of said pair of bracket members, and having a distal end thereof spaced from said surface; and c. support rod including:

i. a substantially straight middle portion disposed, during use of said support rod, in a substantially horizontal position;

ii. a pair of elongated substantially straight portions, each of said pair of elongated portions directly terminating a respective end of said substantially straight middle portion and extending, during said use of said support rod, from said respective end of said substantially straight middle portion in a generally horizontal plane and in a direction toward said surface of a respective mounting bracket;

iii. a pair of second hook shaped members extending, during said use of said support rod, in said generally vertical plane and oriented along a length of said substantially straight middle portion of said support rod, each of said pair of second hook shaped members having a proximal end thereof attached to and directly terminating an end of a respective one of said pair of elongated portions and having a distal end thereof supported, in abutting engagement, on a distal end of a respective one of said pair of first hook shaped members.

* * * * *